US012529383B1

(12) United States Patent
Zheng

(10) Patent No.: US 12,529,383 B1
(45) Date of Patent: Jan. 20, 2026

(54) BLADELESS FAN

(71) Applicant: JOININ GLOBAL PTE. LTD., Singapore (SG)

(72) Inventor: Hongbing Zheng, Hangzhou (CN)

(73) Assignee: JOININ GLOBAL PTE. LTD., Singapore (SG)

( * ) Notice: Subject to any disclaimer, the term of this patent is extended or adjusted under 35 U.S.C. 154(b) by 0 days.

(21) Appl. No.: 19/007,575

(22) Filed: Jan. 2, 2025

(30) Foreign Application Priority Data

Nov. 1, 2024 (CN) ..... 202422677752.3

(51) Int. Cl.
*F04D 29/32* (2006.01)
*F04D 19/00* (2006.01)

(52) U.S. Cl.
CPC ..... *F04D 29/325* (2013.01); *F04D 19/002* (2013.01)

(58) Field of Classification Search
CPC ..... F04D 29/327; F04D 29/328
See application file for complete search history.

(56) References Cited

U.S. PATENT DOCUMENTS

2023/0204044 A1* 6/2023 Yoshino ..... F04D 29/326 416/203
2024/0280109 A1* 8/2024 Teramoto ..... F04D 29/281

FOREIGN PATENT DOCUMENTS

KR 101454327 B1 * 10/2014

* cited by examiner

*Primary Examiner* — Courtney D Heinle
*Assistant Examiner* — Danielle M. Christensen
(74) *Attorney, Agent, or Firm* — IPRTOP LLC

(57) ABSTRACT

A bladeless fan includes a housing body and an axial flow impeller detachably connected within the housing body. Centers of the housing body and axial flow impeller are located on the same central axis. The axial flow impeller includes a fan blade support plate and multiple axial flow fan blades fixed on the fan blade support plate. The axial flow fan blades include at least two different kinds of inner fan blades and outer fan blades. Integrally formed fan blades and housing ensure strength. Built-in installation prevents safety hazards like breakage or detachment. Upper air inlet adopts a group of curved blades with three different angles disposed evenly. Concave structure with a lower interior and a higher exterior forms multiple passages for air compression and acceleration. Lower blades of same size and shape are evenly distributed, ensuring a ring structure to discharge air uniformly and silent operating at high speeds.

9 Claims, 9 Drawing Sheets

BLADELESS FAN

FIELD OF THE INVENTION

The present application relates to the technical field of fans, specifically relates to a bladeless fan.

BACKGROUND OF THE INVENTION

In daily life and work, fans have a wide range of applications as cooling devices. For example, by making the air flow and accelerating the conduction and discharge of heat, the temperature of the environment can be reduced. On equipment that requires heat dissipation, such as computers, televisions, and lamps, fans are installed to remove the heat generated during operation, maintain the operating temperature within a reasonable range, and extend the equipment's service life.

At present, the traditional fans cannot adapt to the growing needs of people due to the disadvantages of large noise and the like, and mainly has the following problems:

(1) Conventional fans are noisy.

(2) Assembled by independent structural fan blades and housing, it is easy to cause safety hazards such as installation breakage or detachment.

(3) The high rotational speed of the fan brings noise and uneven airflow, which in turn causes a significant reduction in the service life of the fan.

SUMMARY OF THE INVENTION

The present application provides a bladeless fan. The bladeless fan includes a housing body and an axial flow impeller. The axial flow impeller is detachably connected within the housing body. A center of the housing body and a center of the axial flow impeller are located on the same central axis. The axial flow impeller includes a fan blade support plate and a plurality of axial flow fan blades. The axial flow fan blades are fixedly disposed on the fan blade support plate. The axial flow fan blades include inner fan blades and outer fan blades. The inner fan blades include at least two different kinds of blades.

In one embodiment of the present application, the inner fan blades include three different kinds of fan blades: first fan blades, second fan blades, and third fan blades. The inner fan blades are disposed in groups on the fan blade support plate in a circular shape.

In one embodiment of the present application, each of the groups includes at least one first fan blade, one second fan blade, and one third fan blades.

In one embodiment of the present application, heights of the first fan blades are lower than heights of the second fan blades. The heights of the second fan blades are lower than heights of the third fan blades.

In one embodiment of the present application, lengths of the first fan blades are less than lengths of the second fan blades. The lengths of the second fan blades are less than lengths of the third fan blades.

In one embodiment of the present application, the numbers of the first fan blades, the second fan blades, and the third fan blades in each group are the same, respectively, and the first fan blades, the second fan blades and the third fan blades in each group are disposed from low to high.

In one embodiment of the present application, the numbers of the first fan blades, the second fan blades, and the third fan blades in each group are the same, respectively, and the first fan blades, the second fan blades and the third fan blades in each group are disposed from short to long.

In one embodiment of the present application, the inner fan blades form inner blade horizontal included angles with a plane of the fan blade support plate, and the inner blade horizontal included angles are less than or equal to a predetermined blade horizontal included angle.

In one embodiment of the present application, a blade included angle is formed between adjacent inner fan blades, and the blade included angle is less than or equal to a blade included angle threshold.

In one embodiment of the present application, the inner fan blades present a concave structure with a lower interior and a higher exterior. First ends of the inner fan blades near a center of the fan blade support plate are lower than second ends of the inner fan blades near an edge of the fan blade support plate. Heights of the second ends of the inner fan blades near the edge of the fan blade support plate are all the same to form multiple airflow passages to squeeze the air volume and accelerate the airflow speed. A high blade included angle is formed between two adjacent highest inner fan blades, and the high blade included angle has a preset value.

As described above, the bladeless fan of the present application has the following beneficial effects:

In the structure of the bladeless fan provided in the present application, the upper air inlet adopts a group of curved blades with three different angles disposed evenly, the concave structure with a lower interior and a higher exterior form a plurality of airflow passages to squeeze the air volume and facilitate the acceleration of the airflow speed, and the sizes and shapes of the lower blades are consistent and evenly distributed so that a ring structure can discharge air evenly and the fan blades can maintain silent operation even at high rotational speeds.

The structure of the bladeless fan of the present application can form a strong wind through a large amount of airflow generated by the high-speed rotating blades, avoiding the problems of noise and uneven wind power caused by the high rotational speed of the traditional fan, and at the same time, improving the service life. This design method not only solves the safety issues of traditional ceiling fan lights, but also provides users with a more efficient, environmentally friendly, and quiet experience.

The bladeless fan of the present application has a simple and beautiful structure with a small size. The structure and components of the new bladeless fan are highly versatile, with a wide range of applications and great practical value.

DETAILED DESCRIPTION

The present application is further described below in conjunction with the accompanying drawings, but the scope of protection of the present application is not limited to that described below.

The specific embodiments are described below to illustrate the implementation of the present application, and those skilled in the art can easily understand other advantages and effects of the present application from the content disclosed in this specification. The present application can also be implemented or applied in other specific embodiments. The details provided in this description can be modified or altered in various ways based on different perspectives and applications without departing from the spirit of the present application. It should be noted that the embodiments and features of the embodiments in the present application can be combined with each other as long as there is no conflict.

It should be noted that the illustrations provided in the following embodiments are merely schematic representations to explain the basic concepts of this application. Therefore, the figures only show components related to this application and are not drawn according to the actual number, shape, and size of components in practice. The actual implementation may involve variations in the type, quantity, and proportions of the components, and the layout of the components could be more complex.

The following embodiments of the present application provide a bladeless fan to solve technical problems in existing traditional fan structures, such as excessive noise and uneven wind caused by the high rotational speed of the fans, which in turn significantly reduce the service life of the fans.

Embodiments of the present application provide a bladeless fan, which adopts an advanced airflow dynamics theory. The fan generates strong wind through a large air flow from high-speed rotating blades, avoiding the problems of high noise and uneven wind caused by the high speed of traditional fans, while also improving service life. This design method not only solves the safety issues of traditional ceiling fan lights, but also provides users with a more efficient, environmentally friendly and quiet experience.

Embodiments of the principle of the bladeless fan of the present application will be described in detail below with reference to the accompanying drawings.

Figure 1A:
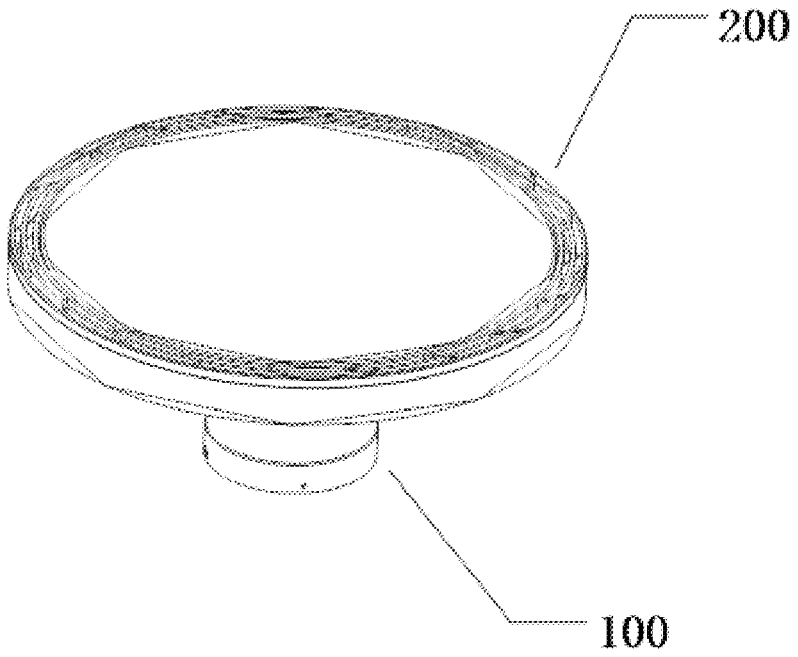
FIG. 1A shows a top view of a general structure of a bladeless fan according to one embodiment of the present application.
Figure 1B:
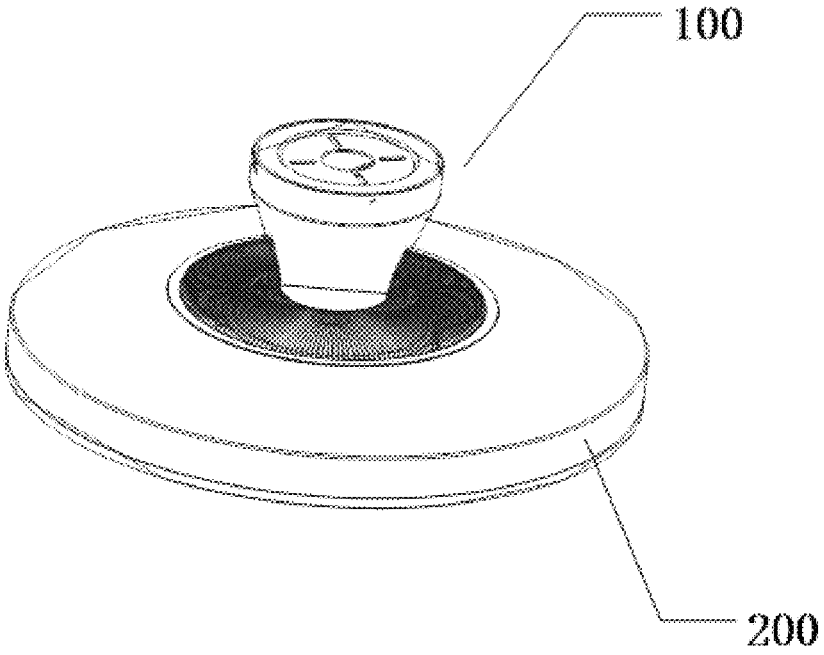
FIG. 1B shows a schematic diagram of an appearance of a bladeless fan according to one embodiment of the present application.
Figure 2:
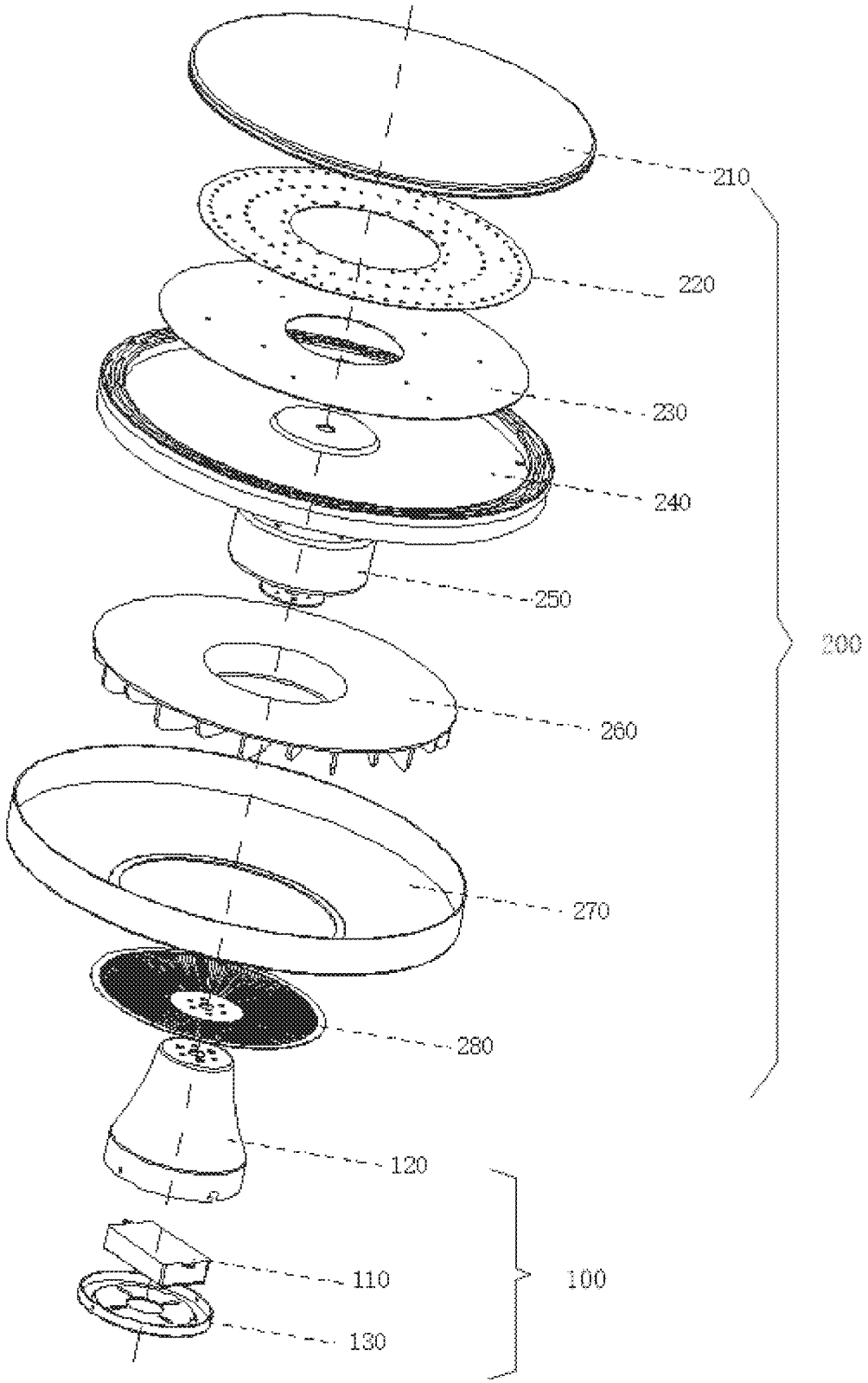
FIG. 2 shows an exploded view of a bladeless fan according to one embodiment of the present application.
Figure 3A:
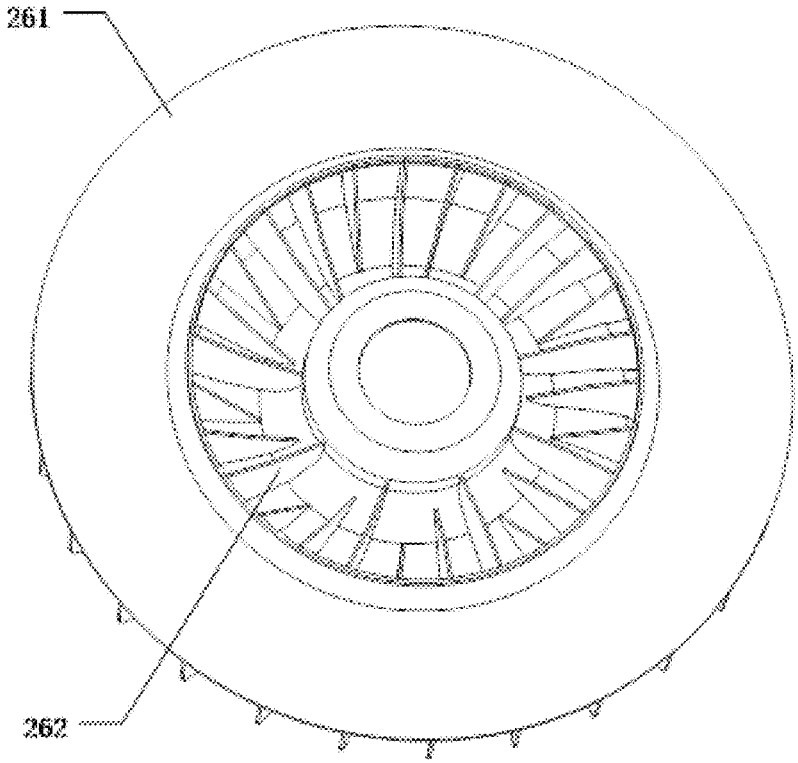
FIG. 3A shows a perspective structural diagram of an axial flow impeller of a bladeless fan according to one embodiment of the present application.
Figure 3B:
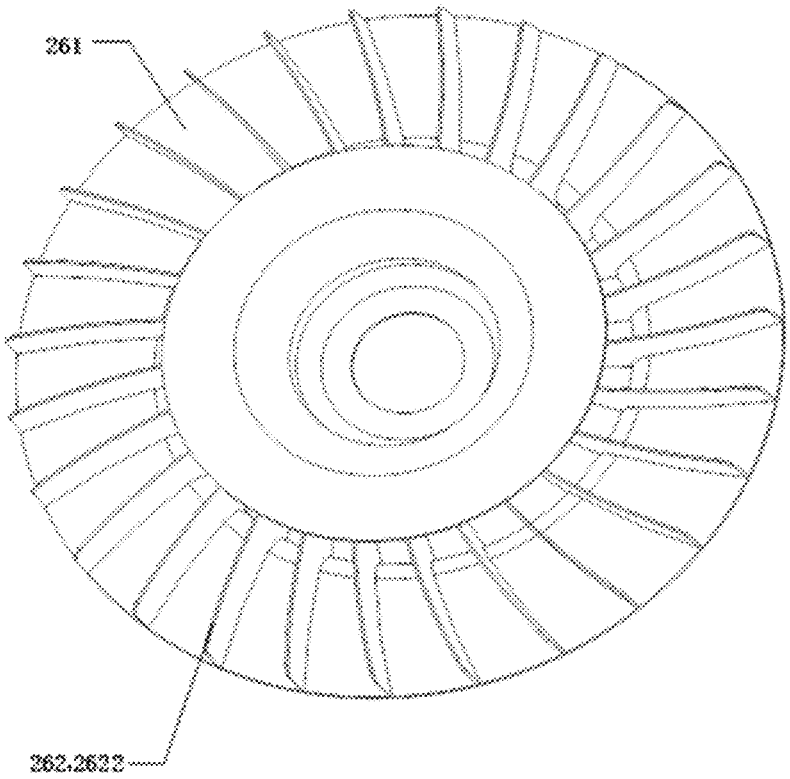
FIG. 3B shows a perspective structural diagram of an axial flow impeller of a bladeless fan according to another embodiment of the present application.
Figure 4A:
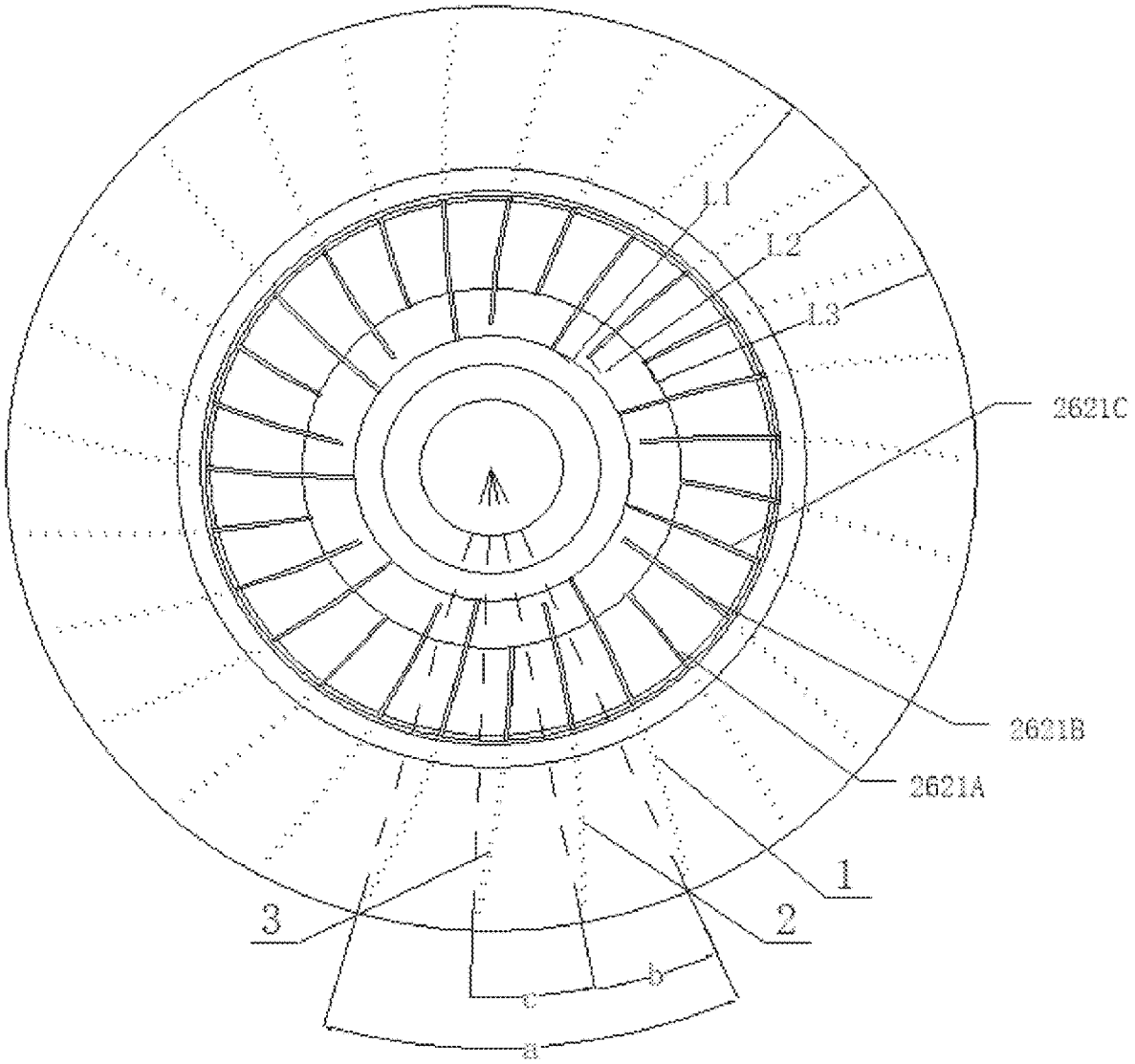
FIG. 4A shows a front view of axial flow fan blades of an axial flow impeller according to one embodiment of the present application.
Figure 4B:
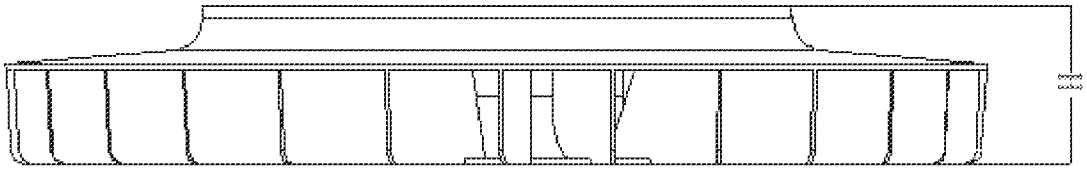
FIG. 4B shows a side view of axial flow fan blades of an axial flow impeller according to one embodiment of the present application.
Figure 5:
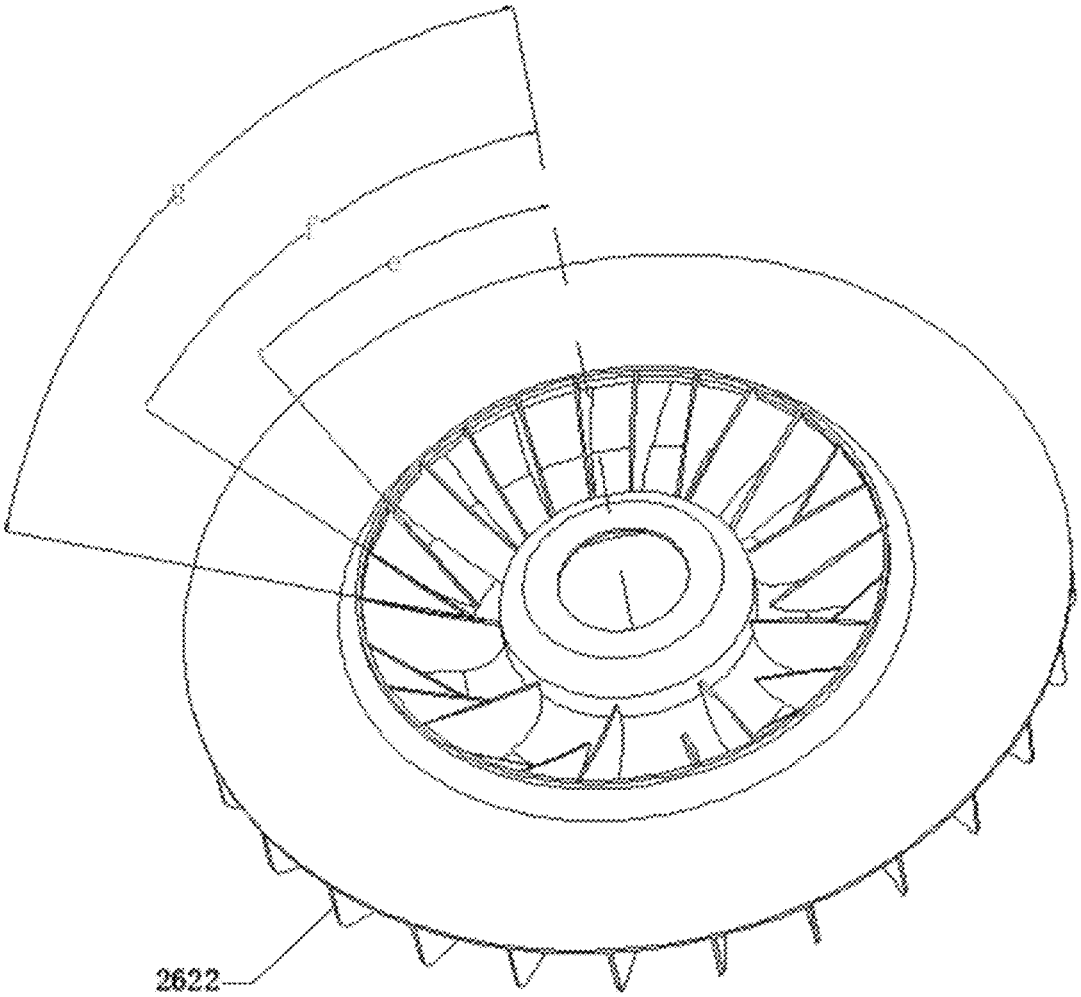
FIG. 5 shows a schematic diagram of angles of axial flow fan blades of an axial flow impeller according to one embodiment of the present application.
Figure 6A:
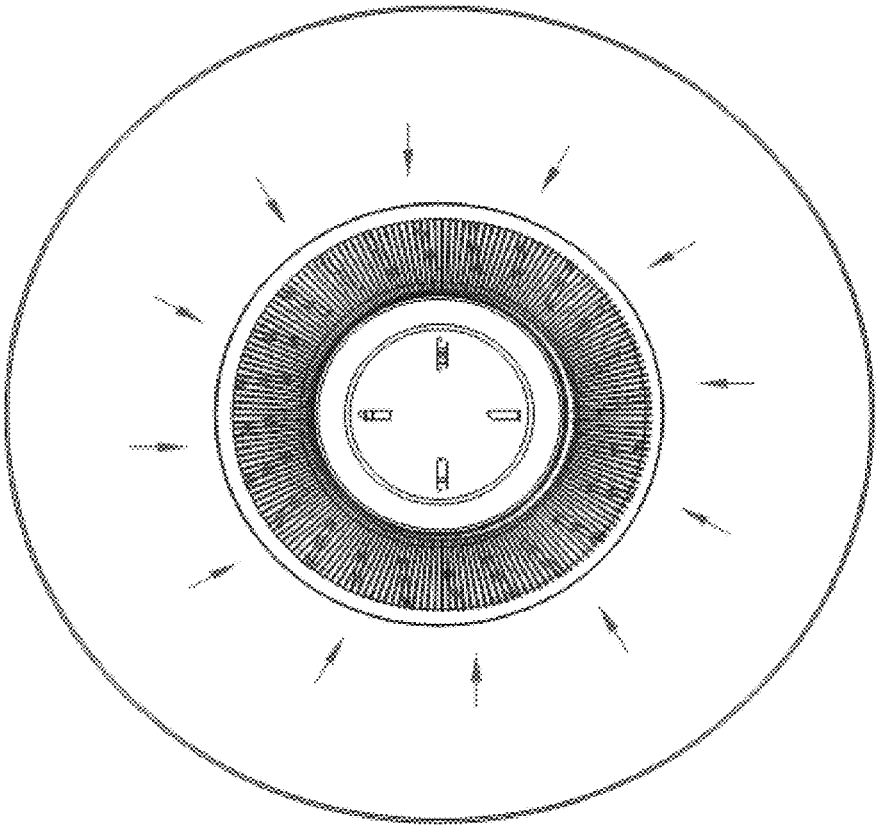
FIG. 6A shows a top view of an air inlet of a bladeless fan according to one embodiment of the present application.
Figure 6B:
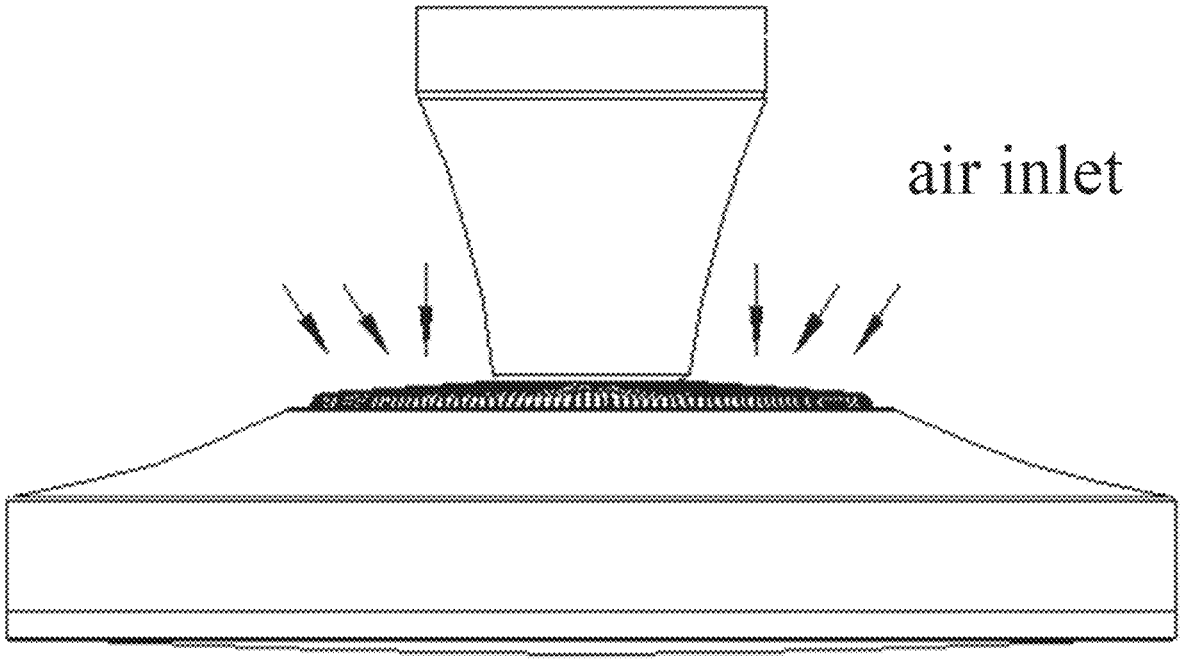
FIG. 6B shows a side view of an air inlet of a bladeless fan according to one embodiment of the present application.
Figure 6C:
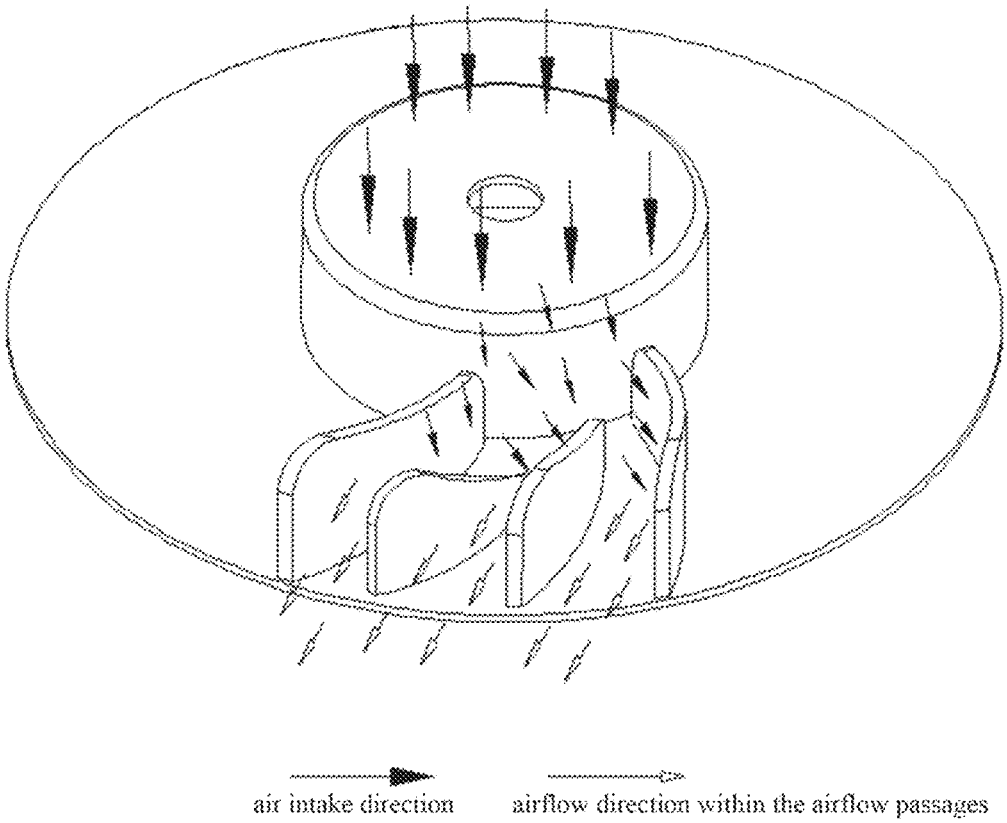
FIG. 6C shows a schematic diagram of operation principle of axial flow fan blades according to one embodiment of the present application.
Figure 6D:
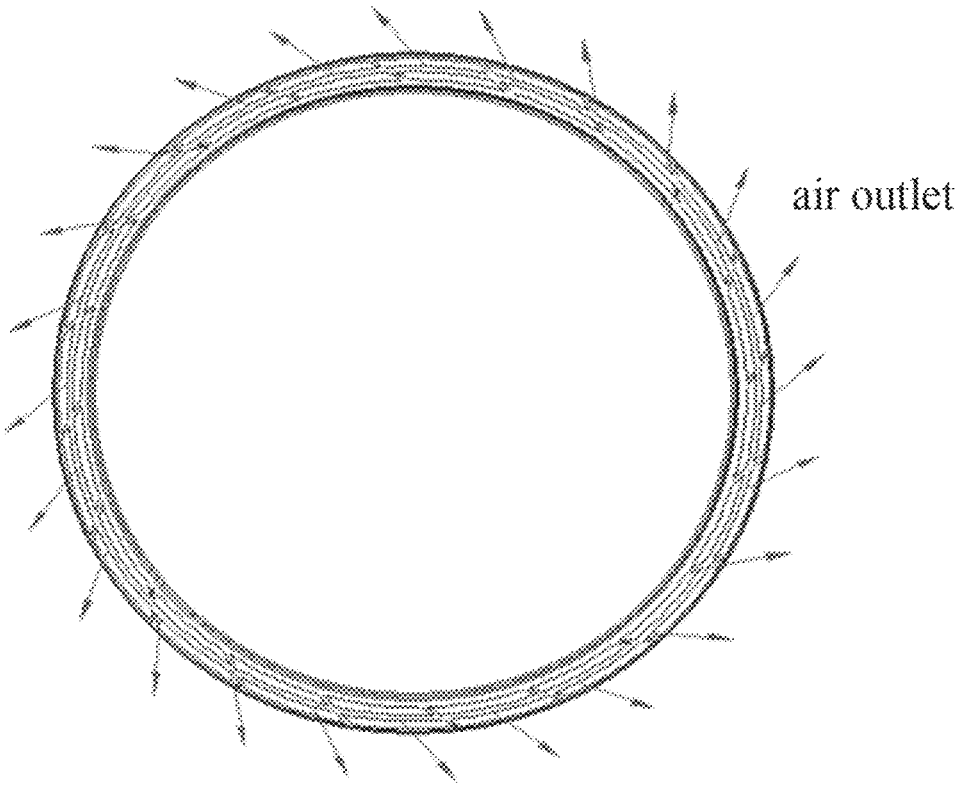
FIG. 6D shows a top view of an air outlet of a bladeless fan according to one embodiment of the present application.
Figure 7:
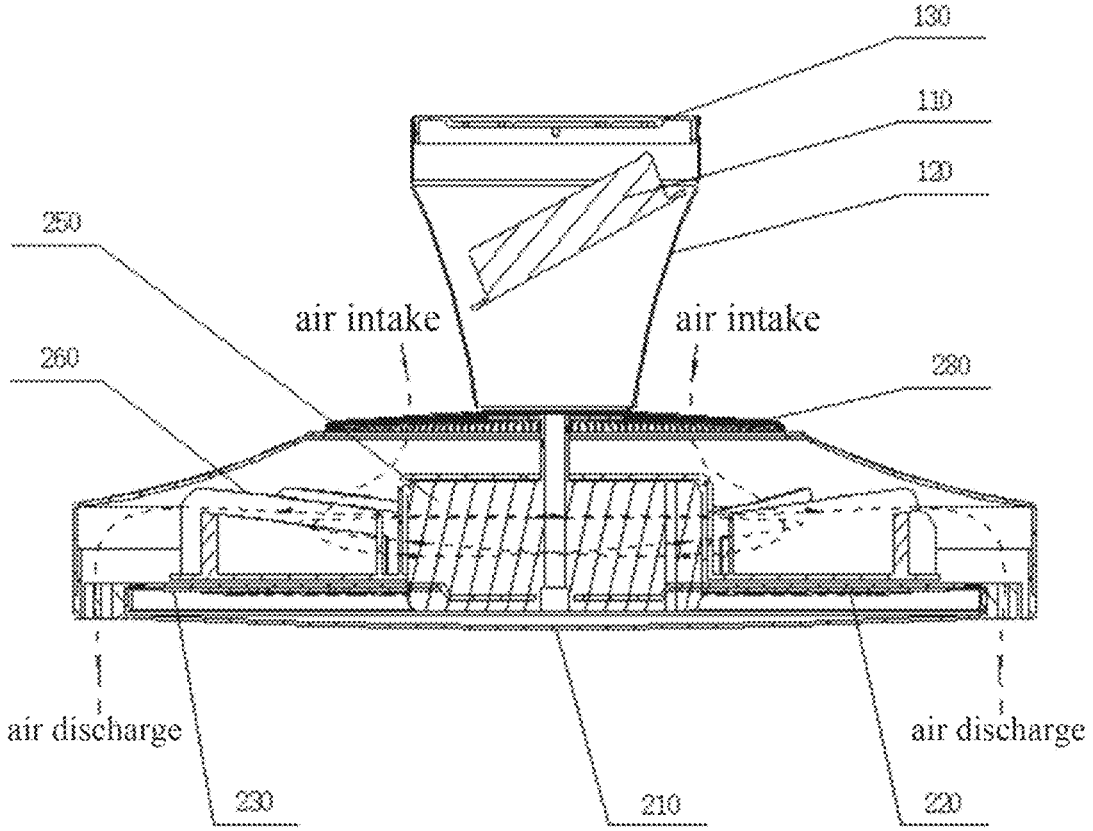
FIG. 7 shows a schematic diagram of air intake and air discharge directions according to one embodiment of the present application.
Figure 8:
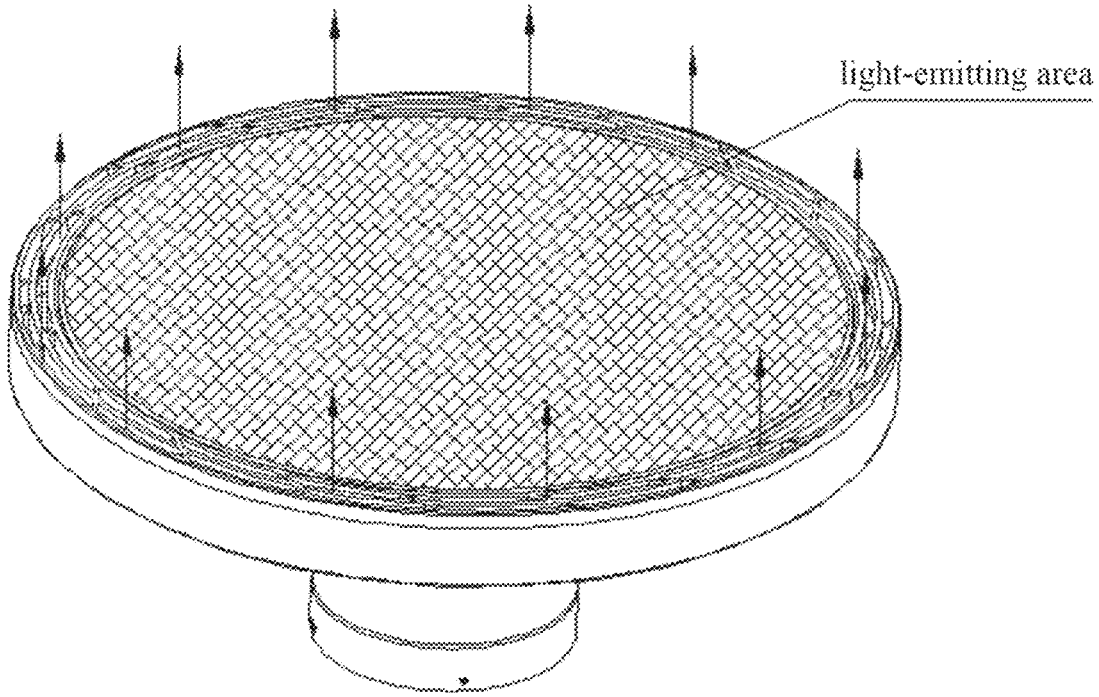
FIG. 8 shows a schematic diagram of a light-emitting display area according to one embodiment of the present application.

Please refer to FIGS. 1A, 1B, and 2, which show, respectively, a top view of a general structure of a bladeless fan according to one embodiment of the present application, a schematic diagram of an appearance of a bladeless fan according to one embodiment of the present application, and an exploded view of a bladeless fan according to one embodiment of the present application. As shown in FIGS. 1A, 1B, and 2, the bladeless fan 1 includes a first structure 100 and a second structure 200. The first structure 100 is fixedly connected to the second structure 200, and a central axis of the first structure 100 coincides with a central axis of the second structure 200. This fan structure reduces the size of the fan and improves the customer experience without changing the main structure or function.

In one embodiment, the first structure 100 includes a chassis back cover 130, a controller 110, and a chassis 120. The second structure 200 includes a housing body 240 and an axial flow impeller 260.

Specifically, the controller 110 of the first structure 100 is disposed within the chassis 120 for fixing, and the chassis back cover 130 is used for sealing and fixing.

The axial flow impeller 260 of the second structure 200 is detachably connected within the housing body 240. A center of the housing body 240 and a center of the axial flow impeller 260 are located on the same central axis.

Please refer to FIGS. 3A, 3B, 4A, 4B and 5, which show, respectively, a perspective structural diagram of an axial flow impeller according to one embodiment of the present application, a perspective structural diagram of an axial flow impeller according to another embodiment of the present application, a front view of axial flow fan blades of an axial flow impeller according to one embodiment of the present application, a side view of axial flow fan blades of an axial flow impeller according to one embodiment of the present application, and a schematic diagram of angles of axial flow fan blades of an axial flow impeller according to one embodiment of the present application.

The axial flow impeller 260 includes a fan blade support plate 261 and a plurality of axial flow fan blades 262. The axial flow fan blades 262 are fixedly disposed on the fan blade support plate 261, and the plurality of axial flow fan blades 262 is provided on the same plane of the fan blade support plate 261.

In one embodiment, the axial flow fan blades 262 include inner fan blades 2621 and outer inner fan blades 2622.

The inner fan blades 2621 adopt at least two different kinds of fan blades and the inner fan blades are uniformly disposed. The outer fan blades 2622 are uniformly disposed on the fan blade support plate 261 to ensure even air discharge. In an example, the inner fan blades include three different kinds of fan blades: first fan blades 2621A, second fan blades 2621B and third fan blades 2621C. The inner fan blades are disposed in groups on the fan blade support plate in a circular shape. Each of the groups includes at least one first fan blade 2621A, one second fan blade 2621B and one third fan blades 2621C.

In one embodiment, the different inner fan blades have different lengths. The inner fan blades of different lengths are sequentially and uniformly disposed from short to long to form angled multi-airflow passages. A high blade included angle is formed between two adjacent highest inner fan blades, and the high blade included angle has a preset value.

That is, heights of the first fan blades 2621A are lower than heights of the second fan blades 2621B. The heights of the second fan blades 2621B are lower than heights of the third fan blades 2621C. Lengths of the first fan blades 2621A are less than lengths of the second fan blades 2621B. The lengths of the second fan blades 2621B are less than lengths of the third fan blades 2621C. Meanwhile, the numbers of the first fan blades 2621A, the second fan blades 2621B and the third fan blades 2621C in each group are the same, respectively, and the first fan blades 2621A, the second fan blades 2621B and the third fan blades 2621C in each group are disposed from low to high. Meanwhile, the first fan blades 2621A, the second fan blades 2621B and the third fan blades in each group 2621C are disposed from short to long.

In one embodiment, the inner fan blades 2621 can adopt at least two types of curved fan blades with different specifications and sizes disposed in sequence. A center axis of the fan adopts a closed structure and is integrated with the fan blades. The different angles of different fan blades and the different included angles among the different fan blades further form multi-squeeze acceleration passages after the air enters, thus ensuring the even discharge of air.

Specifically, the inner fan blades 2621 in this embodiment preferably adopt three types of curved fan blades with different heights. That is, the inner fan blades 2621 include first fan blades 2621A, second fan blades 2621B, and third fan blades 2621C.

The heights and lengths of the first fan blades 2621A, the second fan blades 2621B, and the third fan blades 2621C are all different. Preferably, the lengths of the first fan blades 2621A are L1, the lengths of the second first fan blades 2621B are L2, and the lengths of the third first fan blades 2621C are L3. Moreover, L1 is greater than L2, and L2 is greater than L3, i.e., L1>L2>L3. Meanwhile, the lengths of the first fan blades 2621A, the second fan blades 2621B, and the third fan blades 2621C are all less than a radius of the support plate.

Similarly, the outer fan blades 2622 are disposed in one-to-one correspondence with the positions of the inner fan blades 2621 and are uniformly disposed on the fan blade support plate 261 to ensure the even discharge of air.

Further, the inner fan blades 2621 form inner blade horizontal included angles with the plane of the fan blade support plate 261, and the inner blade horizontal included angles are less than or equal to a predetermined blade horizontal included angle.

A blade included angle is formed between adjacent inner fan blades 2621, and the blade included angle is less than or equal to a blade included angle threshold.

Specifically, preferably, the predetermined blade horizontal included angle is preset to be 50°, the high blade included angle is about 40°, and the blade included angle threshold is 15°. Taking the three different heights of curved fan blades adopted above as examples, it can be seen that the first fan blades 2621A, the second fan blades 2621B, and the third fan blades 2621C each form certain angles with the fan blade support plate 261, which are: a first included angle e for the first fan blades 2621A, a second included angle f for the second fan blades 2621B, and a third included angle g for the third fan blades 2621C, and none of the three inner blade included angles exceeds the predetermined blade horizontal included angle of 50°. At the same time, when the height of the first fan blades 2621A is set to be the highest, an included angle $\alpha$ between the adjacent highest fan blades (i.e., two adjacent first fan blades 2621A) is set to about 40°.

Further, an included angle b between the first fan blades 2621A and the second fan blades 2621B is set to not exceed 15°, and an included angle c between the second fan blades 2621B and the third fan blades 2621C is set to not exceed 15°.

For example, the included angle between two adjacent first fan blades 2621A is set to about 40°. If the height of the second fan blades 2621B is set to be the highest, the included angle between two adjacent second fan blades 2621B is set to about 40°, and so on.

In one embodiment, the inner fan blades present a concave structure with a lower interior and a higher exterior. First ends of the inner fan blades near a center of the fan blade support plate 261 are lower than second ends of the inner fan blades near an edge of the fan blade support plate 261. Heights of the second ends of the inner fan blades near the edge of the fan blade support plate 261 are all the same in order to form multiple airflow passages to squeeze the air volume and accelerate the airflow speed.

Specifically, the shapes and heights of tails of all the curved fan blades must be consistent. That is, the shapes and heights of the tails (outer edge end of the fan blade support plate 261) of the first fan blades 2621A, the second fan blades 2621B, and the third fan blades 2621C are identical. The above setting is mainly for the ends of the curved fan blades close to the center of the fan blade support plate 261, and such a setting enables acceleration of the generated airflow.

As can be seen from the above, take the highest inner fan blades as a target, and keep their angles set at around 40° to ensure that during the operation of the fan, a squeezing effect on the airflow can be produced. The axial flow fan blades 262 are formed by uniformly disposing the curved blades of three different heights so that an airflow passage can be formed between each two highest curved blades. Then, a plurality of groups of such blades can form a plurality of airflow passages.

Please continue to refer to FIG. 2, as well as FIGS. 6A, 6B, 6C, 6D, 7, and 8, which show, respectively, a top view of an air inlet of a bladeless fan according to one embodiment of the present application, a side view of an air inlet of a bladeless fan according to one embodiment of the present application, a schematic diagram of operation principle of axial flow fan blades according to one embodiment of the present application, a top view of an air outlet of a bladeless fan according to one embodiment of the present application, a schematic diagram of air intake and air discharge directions according to one embodiment of the present application, and a schematic diagram of a light-emitting display area according to one embodiment of the present application.

In one embodiment, the second structure 200 further includes a lamp shade 210, a light source plate 220, a heat dissipation plate 230, a motor 250, a rear cover 270, and an air intake grille 280.

The air intake grille 280 is disposed at a center of the rear cover 270, and the air intake grille 280 is opposite the curved blades of the axial flow impeller 260 to ensure that the airflow can enter the fan in a smooth manner.

The motor 250 is disposed between the rear cover 270 and the axial flow impeller 260 to ensure that it drives the axial flow impeller 260 to rotate. This setting also saves space and improves space utilization.

The housing body 240 and the axial flow impeller 260 are integrally molded. An air outlet with a ring shape is positioned inset near an outer edge of the housing body 240. The heat dissipation plate 230, the light source plate 220, both with a ring shape, are disposed within a recessed round area of the axial flow impeller 260. This area is covered by the lamp shade and surrounded by the ring-shaped air outlet.

Specifically, the heat dissipation plate 230 is used to dissipate heat for the fan and the light source plate 220. The lamp shade 210 is preferably made of ABS Material.

The present application adopts an integrated closed structure by integrally forming the curved blades and the housing. It can ensure strength and eliminates safety hazards such as breakage or detachment by internal installation. An upper air inlet adopts a group of curved blades with three different angles disposed evenly. The concave structure with a lower interior and a higher exterior form a plurality of airflow passages to squeeze the air volume and facilitate the acceleration of the airflow speed. The sizes and shapes of the lower blades are consistent and evenly distributed so that a ring structure can discharge air evenly. In turn, the fan blades can maintain silent operation even at high rotational speeds.

Specifically, first, after starting the fan, air flows through the air intake grille into the second structure, and the airflow will enter gaps of the curved blades. At this point, the airflow will be obstructed by the different heights and lengths of the curved inner blades and drives the movement of the curved inner blades. Then, by ensuring that the upper air inlet adopts a group of curved blades with three different angles disposed evenly, the maximum included angle between the curved blades and the horizontal plane does not exceed 50°, the center axis of the fan adopts a closed structure and is integrated with the fan blades, the included angle between two adjacent highest fan blades 1 is set to about 40°, the included angle b between blades 2 and blades 1 ≤15°, the included angle c between blades 3 and blades 2 ≤15°, and the shapes and heights H of the tail ends of all curved inner blades are kept the same, multi-squeeze acceleration passages are formed after the air enters, thus ensuring the even discharge of air. At the same time, the lengths of the three curved inner blades satisfy L1>L2>L3, forming the angled multi-airflow passages. Finally, the generated airflow is discharged from the air outlet.

It can be seen that in the structure of the bladeless fan provided in the present application, the upper air inlet adopts a group of curved blades with three different angles disposed evenly, the concave structure with a lower interior and a higher exterior form a plurality of airflow passages to squeeze the air volume and facilitate the acceleration of the airflow speed, and the size and shape of the lower blades are consistent and evenly distributed so that the ring structure can discharge air evenly. Meanwhile, the fan blades can maintain silent operation even at high rotational speeds.

In summary, the present application provides a bladeless fan, which can form a strong wind through a large amount of airflow generated by the high-speed rotating blades, avoiding the problems of noise and uneven wind power caused by the high rotational speed of the traditional fan, and at the same time, improving the service life. At the same time, the bladeless fan of the present application has a compact and beautiful structure with a small size. The structure and components of the new bladeless fan are highly versatile, with a wide range of applications and great practical value.

The embodiments described above serve merely as illustrative examples of the principles and effects of the present application, and are not intended to serve as limitations on the invention. Persons skilled in the art may modify or alter these embodiments without departing from the spirit and scope of the present application. Therefore, any equivalent modifications or alterations made by those skilled in the art, which are consistent with the spirit and technical concepts disclosed in the present disclosure, shall still fall within the scope of the claims of the present application.

The invention claimed is:

1. A bladeless fan, comprising a housing body and an axial flow impeller, wherein the axial flow impeller is detachably connected within the housing body; and wherein a center of the housing body and a center of the axial flow impeller are located on the same central axis;

wherein the axial flow impeller includes a fan blade support plate and multiple axial flow fan blades fixedly disposed on the fan blade support plate;

wherein the axial flow fan blades include inner fan blades and outer fan blades, and the inner fan blades comprise three different kinds of fan blades: first fan blades, second fan blades, and third fan blades; wherein the inner fan blades are disposed in groups on the fan blade support plate in a circular shape.

2. The bladeless fan according to claim 1, wherein each of the groups comprises at least one first fan blade, one second fan blade, and one third fan blade.

3. The bladeless fan according to claim 2, wherein heights of the first fan blades are lower than heights of the second fan blades; and the heights of the second fan blades are lower than heights of the third fan blades.

4. The bladeless fan according to claim 2, wherein lengths of the first fan blades are less than lengths of the second fan blades; and the lengths of the second fan blades are less than lengths of the third fan blades.

5. The bladeless fan according to claim 3, wherein numbers of the first fan blades, the second fan blades, and the third fan blades in each group are the same, respectively.

6. The bladeless fan according to claim 4, wherein numbers of the first fan blades, the second fan blades and the third fan blades in each group are the same, respectively, and the first fan blades, the second fan blades and the third fan blades in each group are disposed from short to long.

7. The bladeless fan according to claim 1, wherein the inner fan blades form inner blade horizontal included angles with a plane of the fan blade support plate, and the inner blade horizontal included angles are less than or equal to a predetermined blade horizontal included angle, wherein the predetermined blade horizontal included angle is preset to be 50°.

8. The bladeless fan according to claim 7, wherein a blade included angle is formed between adjacent inner fan blades;

wherein the blade included angle is less than or equal to a blade included angle threshold, wherein the blade included angle threshold is 15°.

9. The bladeless fan according to claim 1, wherein the inner fan blades present a concave structure with a lower interior and a higher exterior;

wherein first ends of the inner fan blades near a center of the fan blade support plate are lower than second ends of the inner fan blades near an edge of the fan blade support plate; wherein heights of the second ends of the inner fan blades near the edge of the fan blade support plate are all the same to form multiple airflow passages to squeeze the air volume and accelerate the airflow speed.

* * * * *